US008602015B2

(12) United States Patent
Michelon

(10) Patent No.: US 8,602,015 B2
(45) Date of Patent: Dec. 10, 2013

(54) CUTTING CHAIN

(76) Inventor: John Michelon, Crete, IL (US)

( * ) Notice: Subject to any disclaimer, the term of this patent is extended or adjusted under 35 U.S.C. 154(b) by 383 days.

(21) Appl. No.: 12/693,331

(22) Filed: Jan. 25, 2010

(65) Prior Publication Data

US 2010/0206286 A1 Aug. 19, 2010

Related U.S. Application Data

(60) Provisional application No. 61/146,736, filed on Jan. 23, 2009.

(51) Int. Cl.
*B28D 1/08* (2006.01)
*B27B 33/14* (2006.01)

(52) U.S. Cl.
USPC ..... 125/21; 83/830

(58) Field of Classification Search
USPC ..... 125/21; 83/830–833
See application file for complete search history.

(56) References Cited

U.S. PATENT DOCUMENTS

| | | | | |
|---|---|---|---|---|
| 5,215,072 | A * | 6/1993 | Scott | 125/21 |
| 5,386,756 | A * | 2/1995 | Stehle et al. | 83/830 |
| 6,138,658 | A * | 10/2000 | Bell | 125/21 |
| 7,836,808 | B2 * | 11/2010 | Szymanski | 83/833 |
| 2010/0224047 | A1 | 9/2010 | Prodinger | |

FOREIGN PATENT DOCUMENTS

| | | | |
|---|---|---|---|
| SU | 512912 | * | 10/1976 |
| SU | 616127 | * | 10/1978 |
| WO | WO2009056263 A | | 5/2009 |

OTHER PUBLICATIONS

Database WPI Week 19711, Thomson Scientific, London, GB; AN, 1977; A1368Y XP002578863 English Language Abstract of SU 512 912 AI (Forest Power Mechn Inst Voron Forestry Inst, May 10, 1976.
International Search Report (ISR) for PCTUS2010/022006 filed on Jan. 25, 2010 with priority to Jan. 23, 2009, European Patent Office, completed on Apr. 21, 2010 by David Chariot.
International Preliminary Report on Patentability (IPRP) for PCTUS2010/022006 filed on Jan. 25, 2010 with priority to Jan. 23, 2009, European Patent Office, Jul. 26, 2011, Lingfei Bai.

* cited by examiner

*Primary Examiner* — Dung Van Nguyen

(57) ABSTRACT

A cutting chain for cutting concrete and other similar materials having wear and stretch resistant features. In one embodiment, the cutting chain can include chain links having a debris trap for hindering the entry of debris onto bearing surfaces. In one embodiment, side links and a center link can have cooperating members forming a maze-like debris trap and can include a lubricant and/or other barrier material. In a particular arrangement, side links can have annular ribs which can be partially received in annular grooves on a center link to create the maze-like debris trap. In another embodiment, the cutting chain can include chain links having anti-rotation structures to hinder rotation of the fastener relative to the side links. In a particular arrangement, side links can have a protrusion or slot for cooperating with a complementary mating slot or protrusion on the fastener. In another particular arrangement, the side links can have ridges in the fastener receive hole for penetrating the shaft of the fastener to resist rotation thereof.

20 Claims, 20 Drawing Sheets

CUTTING CHAIN

This application claims the benefit of U.S. Provisional Patent Application Ser. No. 61/146,736 filed on Jan. 23, 2009, the entirety of which is incorporated herein by reference.

BACKGROUND

The present disclosure is directed generally to cutting chains and more particularly to cutting chains for chain saws used to cut concrete and other similar material. Even more specifically, the disclosure is directed to cutting chains having anti-rotation members to resist rotation of the fastener relative to the outer links of the chain which can reduce wear and stretching of the cutting chain. The disclosure is also directed to cutting chains having side link to center drive link interfaces which inhibit entry of cutting debris, and to cutting chains having both anti-rotation members and center link and side link interfaces which inhibit entry of debris.

Concrete cutting chains operate under harsh conditions which can cause rapid deterioration of the chain. The concrete cutting process produces a large amount of very fine and abrasive particles and debris. Water is typically used to flush the debris away and to cool the saw and cutting surface. Even with water flushing, debris and water containing debris manages to enter the linkages of the cutting chain.

Debris entering the bearing surfaces where the links of the chain pivot relative to each other results in friction producing wear. The friction created around the bearing surfaces causes the fasteners, which connect the side links of the chain to center drive links, to rotate relative the side links. This rotation can create its own frictional forces which can result in wearing and stretching of the side links of the chain. Stretching increases the distance between each center drive link preventing the teeth of the drive sprocket of the saw from properly engaging the center drive links. Improper engagement of the sprocket with the chain can create additional wearing and eventual failure of the chain.

SUMMARY

In one aspect of the present disclosure a cutting chain includes a plurality of interconnected chain link segments pivotally connected to each other. Each chain link segment includes a center link having front and rear holes, a pair of side links with each side link having front and rear holes and a fastener for pivotally connecting the center link between the pair of side links. The rear holes of the side links and the front hole of the center link align to receive the fastener therethrough. The rear hole of the center link and the front holes of a pair of side links of an adjacent chain link segment receive another fastener to pivotally interconnect the chain link segments to each other to form a looped cutting chain. Each side link includes one of an annular rib or an annular groove surrounding each of the front and rear holes on a side facing the center link and the center link includes the other of the annular rib or annular groove surrounding a respective one of the front and rear holes on both sides of the center link. Each of the annular ribs or annular grooves of the side links cooperate with the other of the annular rib or annular groove of the center link to form a debris trap.

In another aspect of the present invention a cutting chain includes a plurality of pivotally interconnected chain segments. Each chain segment includes a center link having front and rear holes, a pair of side links with each side link having front and rear holes, and a fastener for pivotally connecting one of the pair of side links to each side of the center link. The front holes of the side links and the rear hole of the center link align to receive the fastener therethrough. The front hole of the center link and the rear holes of a pair of side links of an adjacent chain segment receive another fastener to pivotally interconnect the chain segments to form a looped cutting chain. At least one of the side links includes one of a protrusion or a depression for engagement with the fastener to prevent rotation of fastener relative to the at least one side link.

In another aspect of the present invention a cutting chain includes a plurality of pivotally interconnected chain link segments. Each chain link segment includes a center link having front and rear holes, two side links having front and rear holes and a fastener received in the front hole of the center link and rear holes of the two side links to connect the center link between the two side links. The front hole of the center link and the rear holes of a pair of side links of an adjacent chain segment receive another fastener to pivotally interconnect the chain segments to form a looped cutting chain. Each side link includes one of an annular rib or an annular groove surrounding each of the front and rear holes on a side facing the center link and the center link includes the other of the annular rib or annular groove surrounding a respective one of the front and rear holes on each of two sides of the center link. The annular rib or annular groove of the side links cooperate with the other of the annular rib or annular groove of the center link to form a debris trap. Each side link includes either a protrusion or a depression associated with each of the front and rear holes for engage a respective fastener to prevent rotation of the respective fastener relative to the side link.

Other aspects, objects and advantages of the present disclosure will be understood from the following description according to the embodiments disclosed, specifically including stated and unstated combinations of the various features which are described herein and relevant information which is shown in the accompanying drawings and any examples.

BRIEF DESCRIPTION OF THE DRAWINGS

In the following detailed description, reference will frequently be made to the following views of the drawing, in which like reference numerals refer to like components, and in which.

DETAILED DESCRIPTION

As required, detailed embodiments of the present disclosure are provided herein; however, it is to be understood that the disclosed embodiments are merely exemplary of the subject matter of the claims which may be embodied in various forms. Therefore, specific details disclosed herein are not to be interpreted as limiting, but merely as a basis for the claims and as a representative basis for teaching one skilled in the art to variously employ the present subject matter in virtually any appropriate combination and manner.

Figure 1:
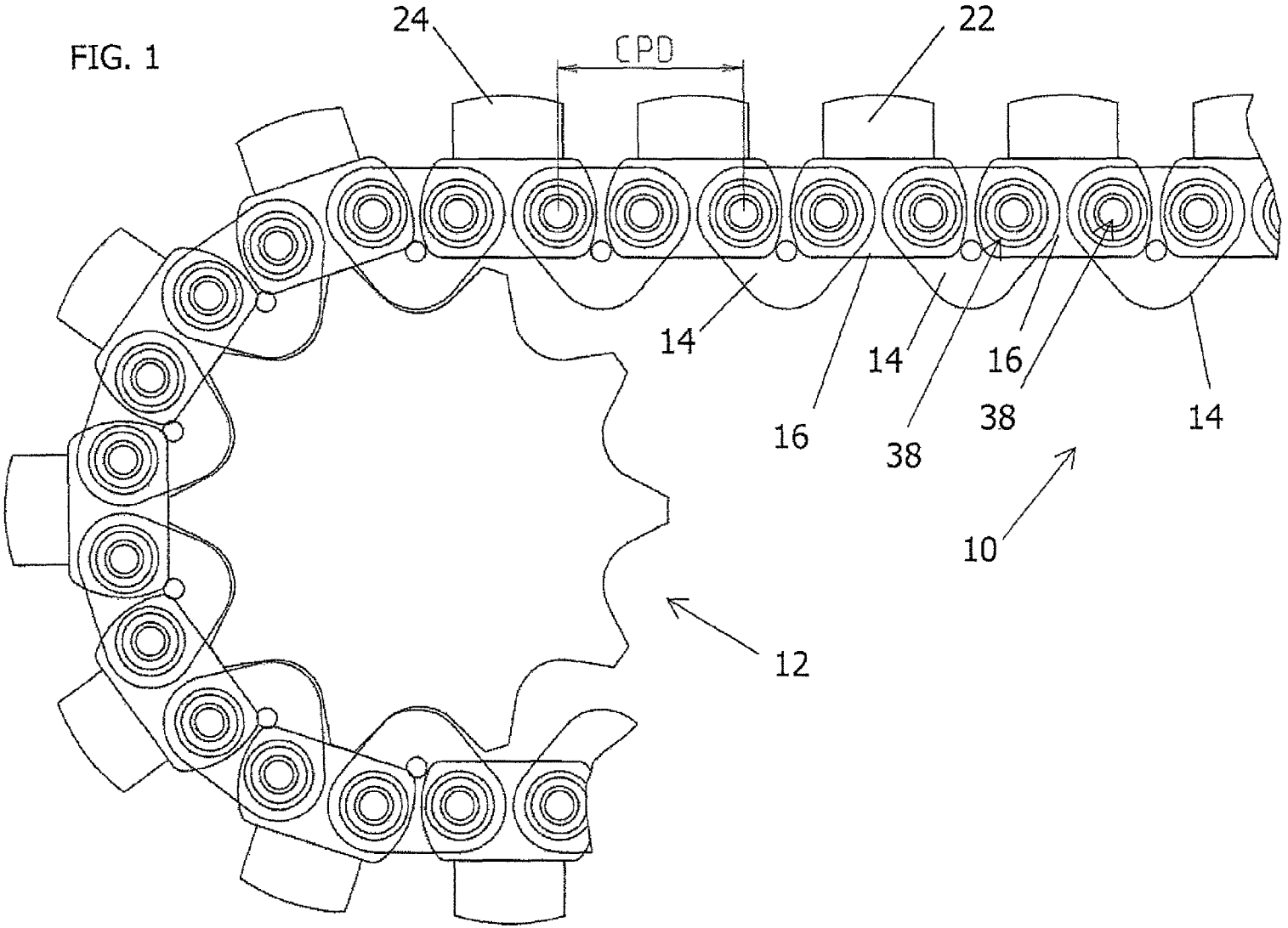
FIG. 1 is an elevation view of a portion of a cutting chain.
Figure 3:
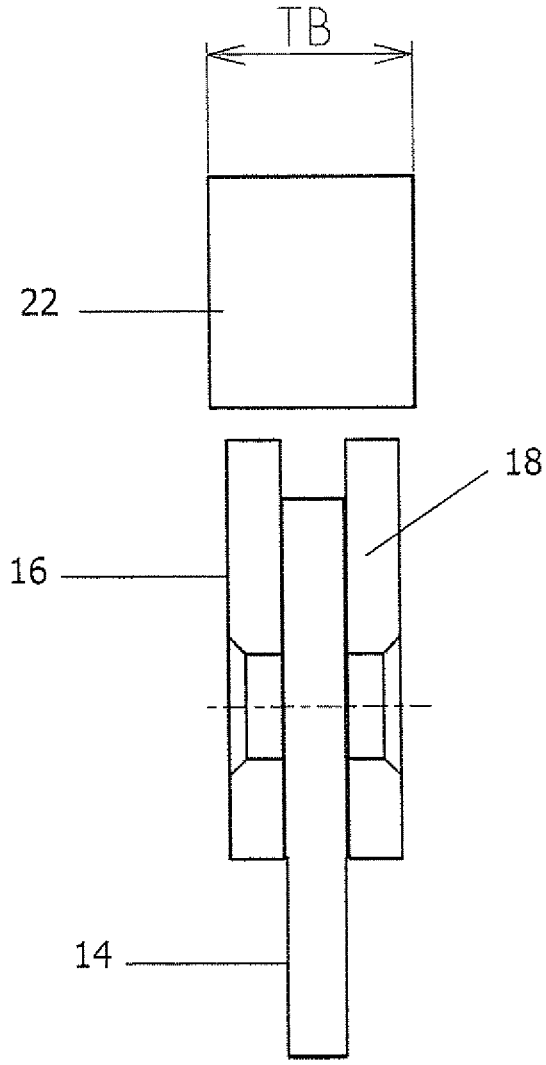
FIG. 3 is an exploded elevation view of one chain link segment of a prior art cutting chain.

FIG. 1 shows one embodiment of cutting chain 10 according to the present invention. Cutting chain 10 can have a debris trap to inhibit debris from reaching the bearing surfaces of the interconnected chain link segments 11. In a typical arrangement, cutting chain 10 can be arranged about sprocket 12 for driving chain 10 around a guide bar (not shown). The cutting portion of chain 10 can be provided by cutting blocks 22 which can have a diamond tipped surface 24 for cutting hard material such as concrete. As shown in FIG. 3 in exploded view, cutting block 22 can be affixed to bridge left and right side links 16, 18 by known methods such as laser welding.

Figure 2:
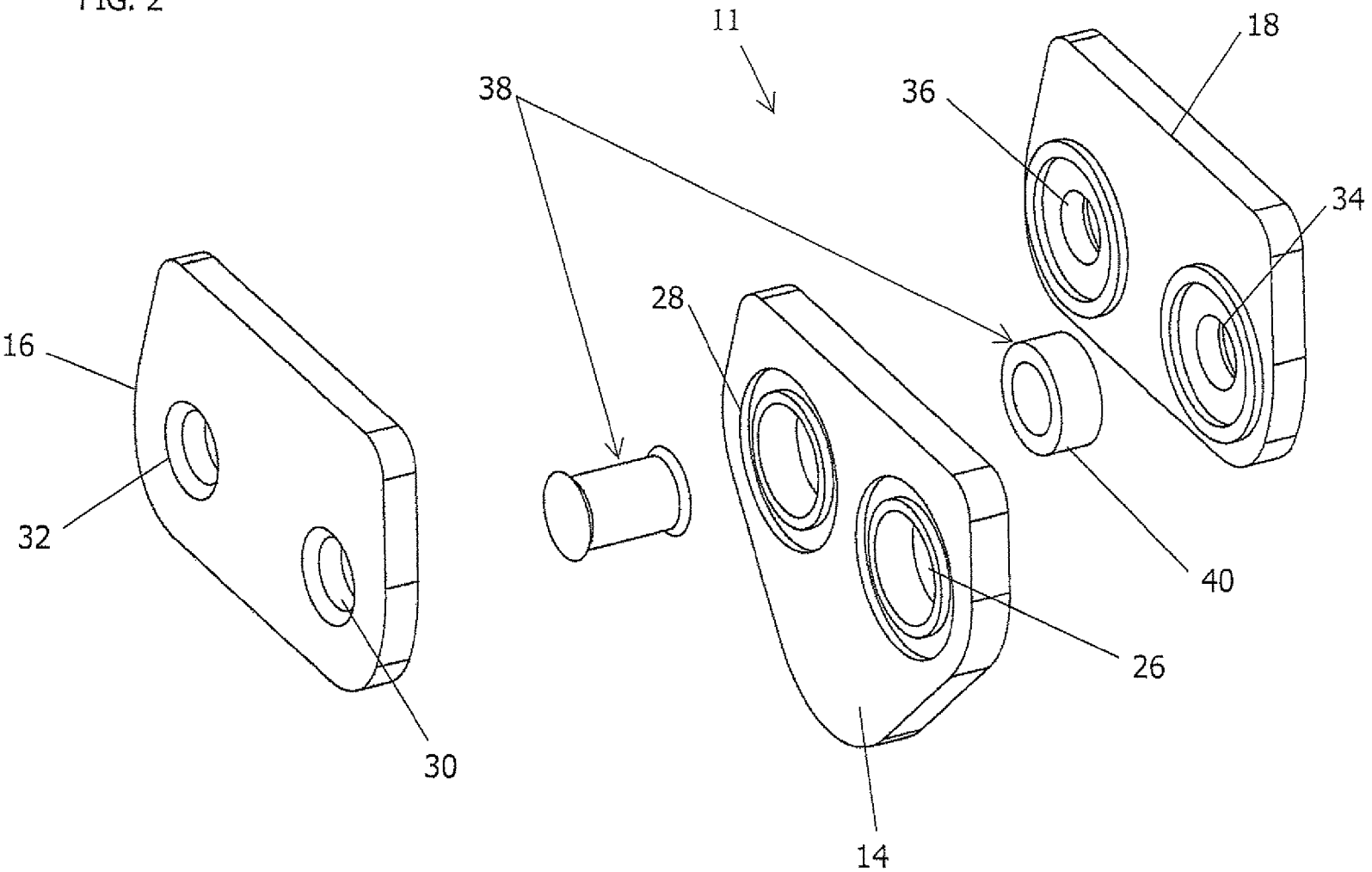
FIG. 2 is an exploded perspective view of one embodiment of a chain link segment of a cutting chain according to the present disclosure.

Chain 10 can have a plurality of chain link segments 11 (shown in an exploded view in FIG. 2) each of which can include center drive link 14 pivotally connected between side links 16, 18 by fastener 38. The arms of the sprocket drive 12 the center drive links 14 to move the chain 10 about the guide bar. Each center drive link 14 can have rear hole 26 and front hole 28 and each of left and right side links 16, 18 can also have rear and front holes 30, 32, 34, 36, respectively. Front hole 28 of center link 14 and rear holes 30 and 36 of left and right side links 16, 18, align to receive fastener 38 which can include bushing 40 to pivotally connect center link 14 to side links 16, 18. Chain link segments 11 can be connected to each other to form the desired length a looped cutting chain 10 by having another fastener 38 and bushing 40 received in aligned front holes 32, 36 of side links 16, 18 of an adjacent chain link segment 11 (not shown in FIG. 4) and rear hole 26 of center link 14 and repeating as desired with terminal chain link segments looped around and connected to each other.

In one embodiment, fastener 38 can be a rivet which can have bushing 40 around a central portion of the rivet. Other suitable fasteners besides rivets can be used. Bushing 40 can be a separate piece fitted to the shaft portion of rivet or can be integrated with the rivet. In the embodiment illustrated in FIG. 4, bushing 40 is a separate piece and can be made of a suitable metal or metal alloy. In one embodiment, bushing 40 can be made of carbon steel for example 52/100 carbon steel.

Figure 4:
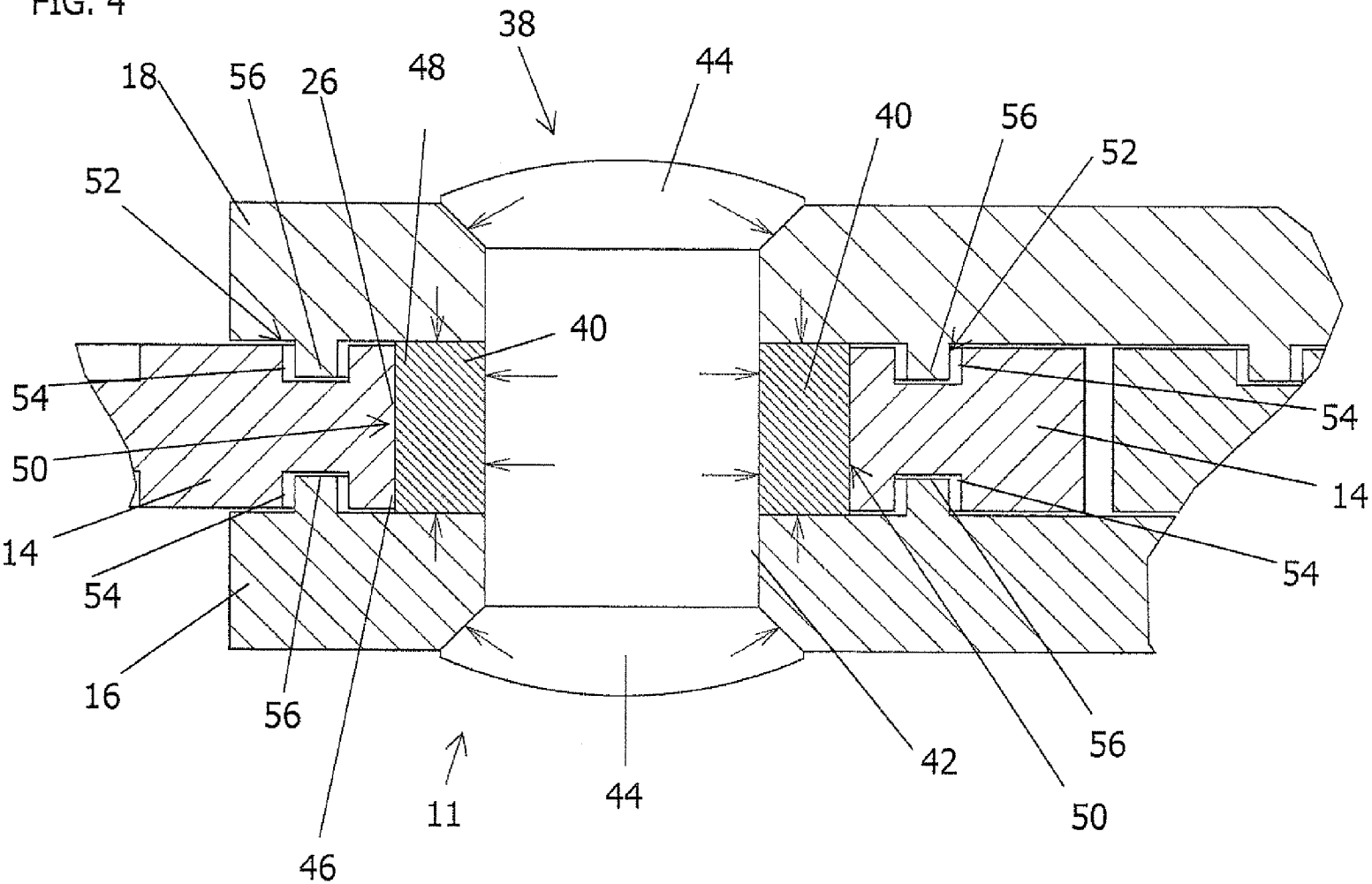
FIG. 4 is cross-sectional view of the chain link segment of FIG. 2.

FIG. 4 shows an assembled chain link segment 11. Left and right side links 16, 18 can be secured to center drive link 14 with fastener 38 which in the illustrated embodiments is a rivet and has bushing 40. The riveting process deforms the ends of shaft of fastener 38 to form opposing heads 44 which can be firmly secured against side links 16, 18. It is believed that the compressive forces (shown with arrows) can create a nearly integrated body consisting of rivet, bushing 40 (if a separate bushing piece is used initially) and side links 16, 18 while allowing center drive link 14 to pivot relative to side links 16, 18 and fastener 38. In other words, center link 14 can pivot about bushing 40 and relative to side links 16, 18.

Center drive link 14 can pivot freely about diameter surface 46 of bushing 40. As such, outer surface 46 and inner annular surface 48 defining rear hole 26 can act as or define bearing surfaces area 50. However, with cutting chains available heretofore debris from the concrete cutting process could reach bearing surface area 50 through pathways or entrances 51 and interfere with the pivoting of central drive link 14 relative to fastener 38 and could result in unnecessary wear and may cause and/or accelerate the stretching of chain 10. It is believed that debris can create binding between center drive link 14 and bushing 40 at the bearing surfaces area 50. Binding can result in torque being applied to bushing 40 and fastener 38. Such repeated binding and resulting torque applied to bushing 40 and fastener 38 can cause fastener 38 to disengage from the secure and nearly integrated connection with side links 16, 18. Once rivet 38 begins to rotate relative to side links 16, 18, frictional forces can result and/or accelerate wearing. As wearing progresses, gaps can form at interfaces between fastener 38 and side links 16, 18 and gaps can lead to stretching of side links 16, 18. Excessive stretching of side links 16, 18 increases the distance between center drive links 14 preventing proper engagement of sprocket 12 with center links 14 (see FIG. 1). This can lead to failure of the chain.

In one embodiment of the present disclosure, chain 10 can include chain links forming a debris trap surrounding each of the holes of the center link on each side of the two sides of the center link. A debris trap impedes debris from reaching bearing surface area 50 by providing a labyrinth or staggered pathway or entrances 51 to bearing surface area 50. FIG. 4 shows one embodiment of debris trap 52 which is in form of staggered pathway or labyrinth. Debris trap 52 can be formed with interacting or cooperating structures provided on center links 14 and side links 16, 18.

Figure 5:
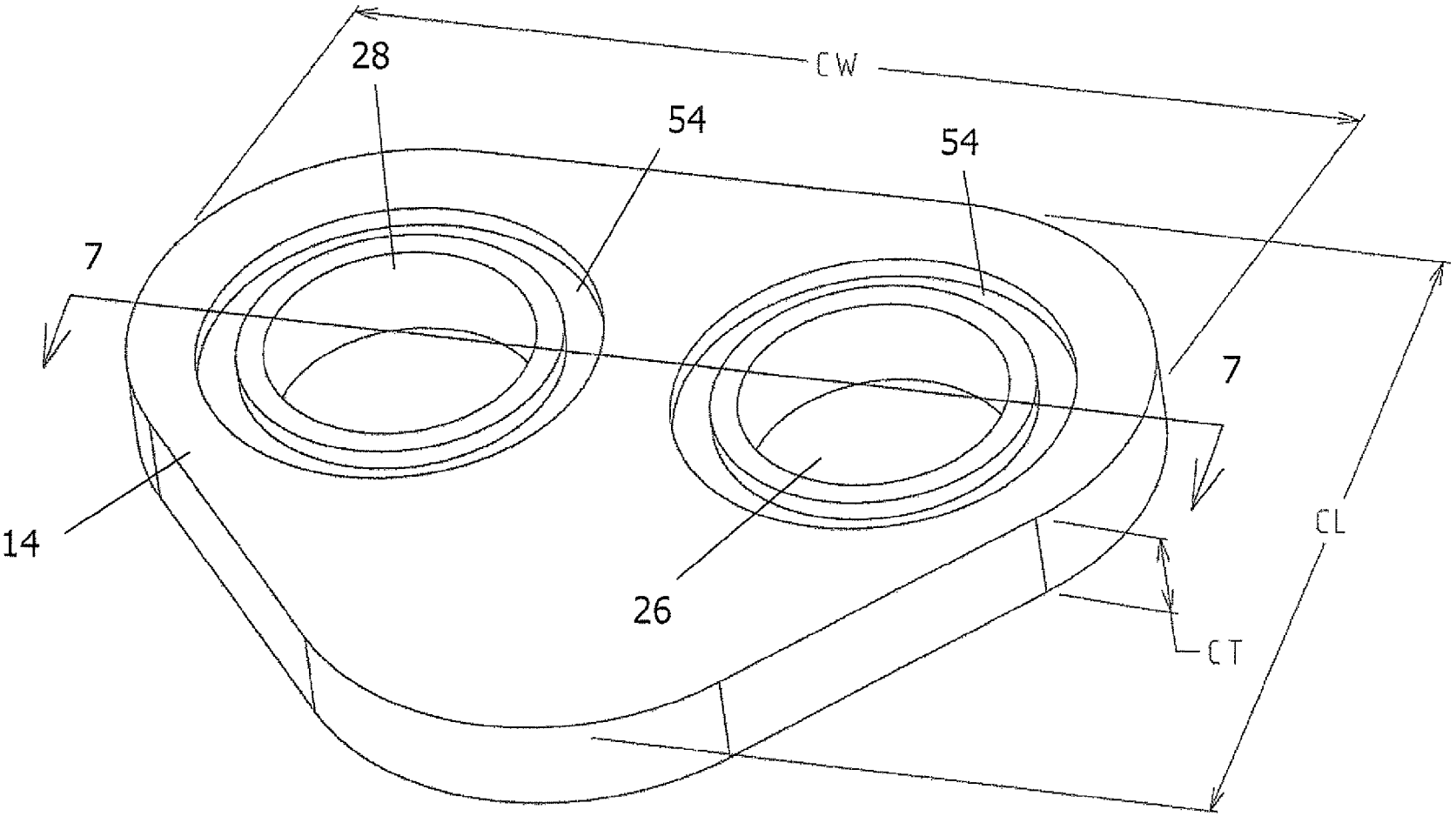
FIG. 5 is a perspective view of one embodiment of a center link according to the present disclosure.
Figure 6:
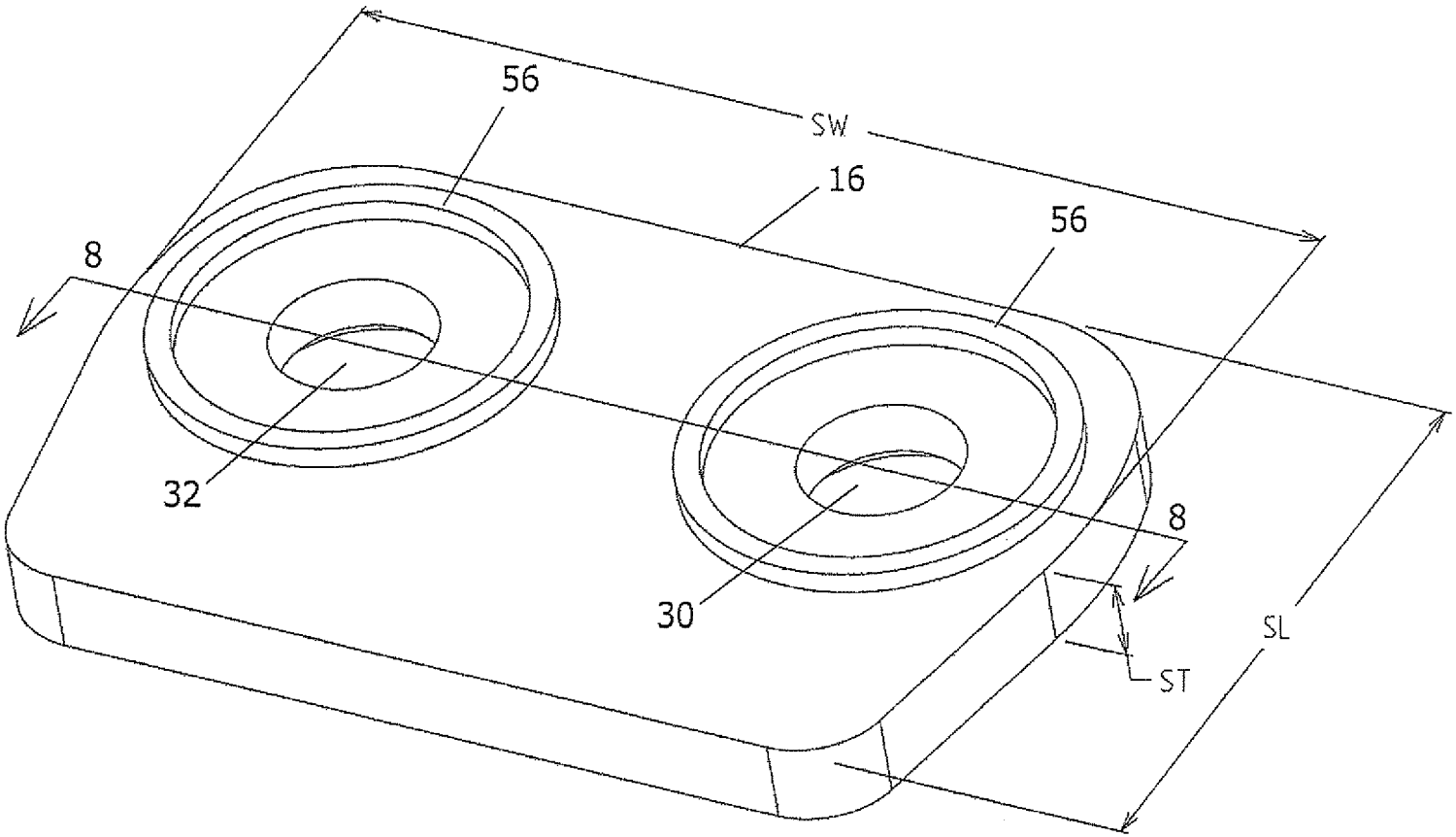
FIG. 6 is a perspective view of one embodiment of a side link according to the present disclosure.

FIG. 5 shows one embodiment of center drive link 14 having a debris trap to inhibit of debris from reaching the bearing surfaces. The debris can be formed with cooperating grooves and ribs on the center link and side links of a chain link segment 11. Center drive link can have annular grooves 54 surrounding each of front and rear holes 26, 28. FIG. 6 shows one embodiment of side link 16 having annular ribs 56 surrounding front and rear holes 32, 30. Annular grooves 54 and ribs 56 can be concentric with a respective front and rear hole. Side link 18 can be identical to or a minor image of side link 16 for ease of manufacturing, inventory control and tooling costs. In one embodiment, side links 16 can be identical to side links 18 and any following reference to side link 16 applies equally to side link 18 unless otherwise noted.

Figure 7:
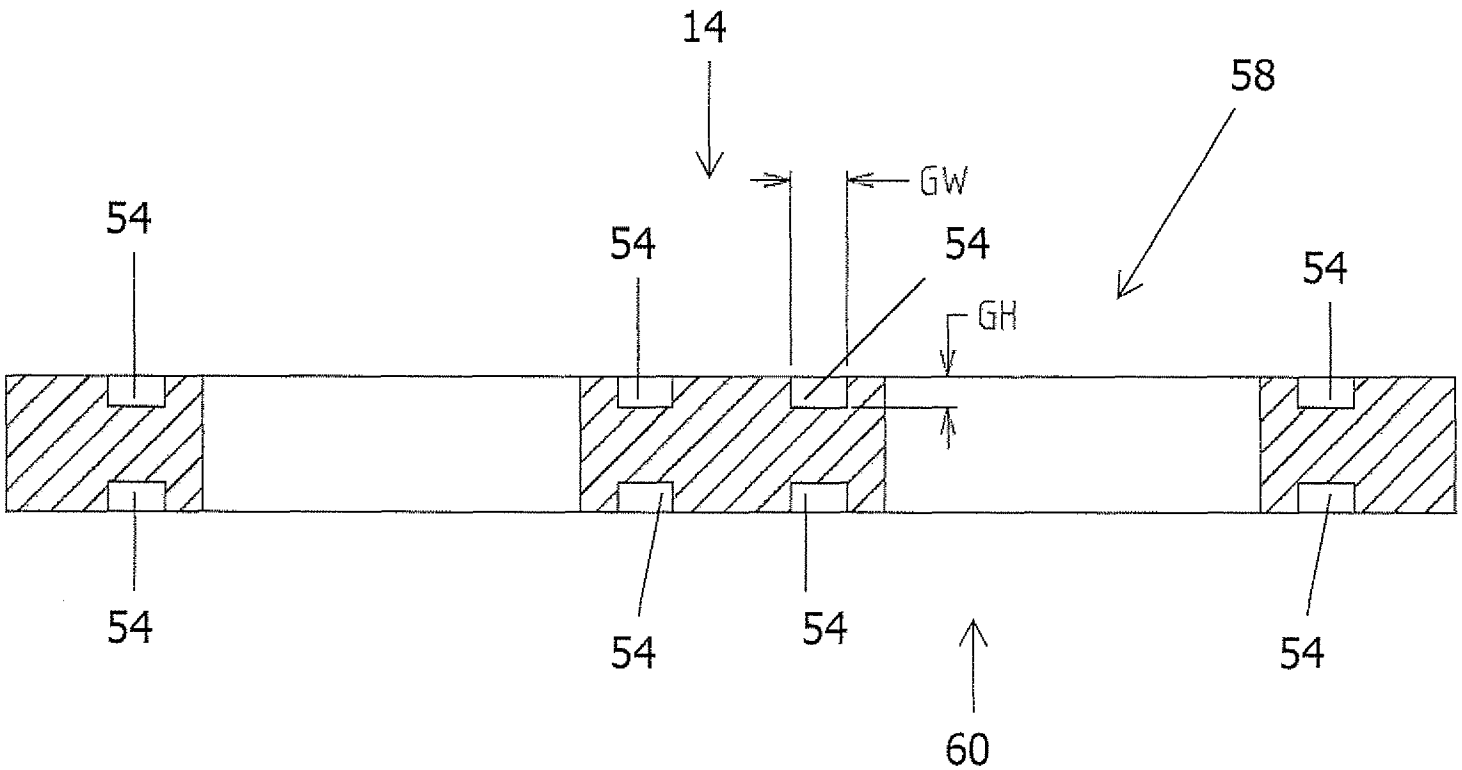
FIG. 7 is a cross-sectional view of the center link shown in FIG. 5 taken at line 7-7.
Figure 8:
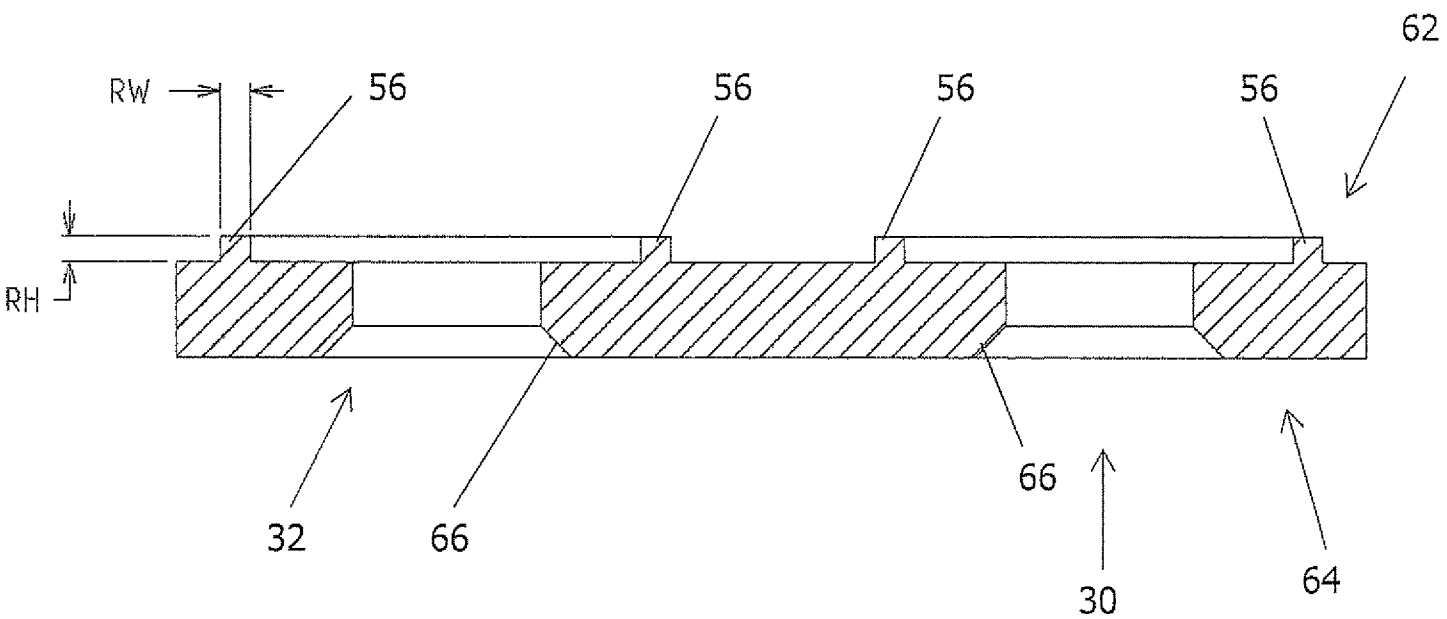
FIG. 8 is a cross-sectional view of the center link shown in FIG. 5 taken at line 8-8.

As shown in FIG. 7, center drive link 14 can have annular grooves 54 surrounding front and rear holes 26, 28 on both opposing sides 58, 60. As shown in FIG. 8 side link 16 can have annular rib 56 protruding from inner surface 62 and surrounding each of front and rear holes 32, 30. Inner surface 62 faces center drive link 14 and outer surface 64 faces center drive link 14 and away (in the opposite direction) from center drive link 14. Grooves and ribs 54, 56 can interact or cooperate to create debris trap 52 (shown in FIG. 4) around and on each side 58, 60 of front and rear hole 28, 26. Additional grooves and ribs can be provided to create additional debris traps about front and rear holes 28, 26 of center drive link 14.

Grooves 54 and ribs 56 can be positioned in any cooperating combination about the front and rear holes of center link 14 and side links 16 and 18 to form debris traps around the front and rear holes and on both sides and of the center drive link 14. For example, center link can have all grooves or all ribs around the front and rear holes of the center link or any combination of grooves and ribs, and side links can have complementary ribs and/or grooves around the respective front and/or rear holes to cooperate in forming the debris trap around each center link hole on both sides of the center link. The center link may also differ in its rib and groove arrangement from one chain link segment to another if desired. In other words, center links need not all have the same arrangement of ribs and grooves. It is understood that side link 16 may not being identical to side link 18 with particular arrangements of grooves and ribs on the center links 14 and among the center links 14.

Grooves 54 and ribs 56 can have cross-sectional shapes other than the rectangular shape shown in the figure, such as square, circular, trapezoidal, etc.

As shown in FIG. 7, grooves 54 and ribs 56 can have any suitable height and width to cooperate in forming the debris trap 52. The dimensions of rib 56, in particular rib height 'RH' and rib width 'RW', can be selected with reference to the thickness of the chain link, i.e. center drive link 14, side link 16 or side link 18, rib 56 is positioned on or extends from. In one embodiment, rib height 'RH' can be from about 10% to about 35% and rib width 'RW' can be from about 20% to about 55% of the thickness of the chain link it is positioned on such as side link thickness 'ST' and center link thickness 'CT'. In another embodiment, rib height 'RH' can be from about 18% to about 26% and rib width 'RW' can be from about 35% to about 50% of the thickness of the chain link it is positioned on. In yet another embodiment, rib height 'RH' can be about 22% and rib width 'RW' can be about 44% of the thickness of the chain link it is positioned on.

Groove 54 can be larger than rib 56 to provide the spacing therebetween to form the debris trap 52 and as such groove height 'GH' and groove width 'GW' can be determined in terms of rib height 'RH' and rib width 'RW', respectively. In one embodiment, groove height 'GH' can be from about 15% to about 30% greater than the rib height 'RH', and groove width 'GW' can be from about 30% to about 55% greater than the rib width 'RW'. In another embodiment, groove height 'GH' can be from about 18% to about 26% greater than the rib height 'RH', and groove width 'GW' can be from about 35% to about 50% greater than the rib width 'RW'. In yet another embodiment, groove height 'GH' can be about 22% greater than the rib height 'RB' and groove width 'GW' can be about 44% greater than the thickness of the rib width 'RW'. In view of the above given groove widths it is understood that when rib 56 is positioned centrally in groove 54 there is equal spacing on every side of rib 56. In other words, when groove height 'GH' is about 20% greater than rib height 'RH' and groove width is about 40% greater than rib width 'RW', there is about 20% extra spacing or clearance on each side of rib 56.

Cutting chains can come in many sizes and are measured in terms of the thickness of chain 'T' as shown in FIG. 3, or in terms of the thickness of the cut the cutting chain 10 will make or the chain pitch. Chain pitch is the distance between any three consecutive fasteners or rivets 'CPD' (see FIG. 1) divided by two. The size of the groove 54 and ribs 56 can also influence how far they will be spaced from the respective front or rear hole.

In the illustrated embodiment of center drive link 14 and side link 16 shown in FIGS. 5 and 6, can have the following dimensions for a cutting chain which has a chain pitch of three-eight inch or 9.5 mm and which will produce a quarter inch cut. Side link 16 width 'SW', length 'SL' and thickness 'ST' can be about 17.7 mm, about 9.9 mm and about 1.44 mm, respectively; spacing between the centers of front and rear holes 32, 30 can be about 10 mm and the diameter of each can be about 2.8 mm. Rib 56 of side link 16 can have a height 'RH' and width 'RW' of about 0.3 mm and about 0.6 mm respectively. Rib 56 can be concentric with its respective front or rear hole 32, 30. The diameter of annular rib 56 from the center of the rib 56 can be from about 1.5 times to 3 times the diameter of the respective front or rear hole it surrounds and in one embodiment is from about 2 to about 2.5 times the diameter of the respective hole it surrounds. In one embodiment, the dimensions of side link 18 can be the same as side link 18.

Center drive link 14 width 'CW', length 'CL' and thickness 'CT' can be about 17.7 mm, about 14.7 mm and about 1.44 mm, respectively; spacing between the centers of front and rear holes 28, 26 can be about 8.7 mm and the diameter of each can be about 4.8 mm. It is understood that front and rear holes 28, 26 can have a greater diameter than front and rear holes 32, 30 of side links 16, 18 to accommodate bushing 40. Groove 54 of center link 14 can have a height 'GH' and width 'GW' of about 0.36 mm and about 0.84 mm respectively. Groove 54 can be concentric with its respective front or rear hole. The diameter of annular groove 54 from the center of the groove 54 can be from about 1.5 times to 3.5 times the diameter of the respective front or rear hole it surrounds and in one embodiment is from about 2 to about 2.5 times the diameter of the respective hole it surrounds.

Grooves and ribs 54, 56 can be formed in many ways. Center and side links 14, 16, 18 can be molded to provide grooves and ribs 54, 56. Alternatively, grooves and ribs can be formed by stamping or punch processes. Holes 26, 28, 30, 32, 34, 36 can likewise be formed by stamping or punching process, or center and side links 14, 16, 18 can be molded in the desired fashion. Outer surface 64 of side link 16 can have beveled or chamfered annular surfaces surrounding front and rear holes 32, 30 to receive head 44 of fastener 38 such as when a rivet is used as the fastener. Center and side links 14, 16, 18 can be formed of any suitable metal or metal alloy. In one embodiment, links 14, 16, 18 can be made from carbon steel.

In another embodiment of the present disclosure, debris trap 52 can include a lubricant and/or barrier material. This can help reduce vibration or other travel of center drive link 14 between side links 16, 18 which can provide smoother travel of cutting chain 10 about the guide bar of a chain saw and still allow the center link to pivot relative to the side links. The material can be a low (thin) or high viscous (heavy) liquid. The material can be a liquid or colloid in its initial state and then solidify after curing or processing. In the solid or cured state, the material can have a high hardness or have the ability to flow or deform somewhat. Any suitable lubricant and/or barrier material may be used. The material can be selected from but not limited to thin or heavy oil, grease whether natural or synthetic, latex, rubber, butanediol, epoxy, acrylate, silicone, siloxane, and mixtures or formulations thereof, among others.

In one embodiment, annular groove 54 is partially or completely filled with a material having a high hardness cured state. Center and side links can then be assembled which may cause some of the material to flow out of groove and into adjacent areas depending on the amount added in the groove 54. The material is then processed or cured into a hardened state.

In another embodiment, annular groove 54 is partially or completely filled with a material which is somewhat pliable or flowable post curing or processing. The material is cured and then center and side links are assembled to each other. When the annular rib enters the annular groove, the cured material can flow into adjacent areas around the rib and groove mating space depending on how much material was added to the annular groove.

In one embodiment, a siloxane and acrylate compound such as Loctite® 5055 was applied in a liquid state to each groove 54 to fill or nearly fill, e.g. 80-100% of the volume of groove 54. The adhesive or sealant was cured under visible or U.V. light e.g. a 400W, 400 nm metal halide lamp for about one minute. The center drive link and side links 14, 16, 18 can then be assembled which forces some of the cured adhesive or sealant into surrounding area of debris trap 52.

Figure 9:
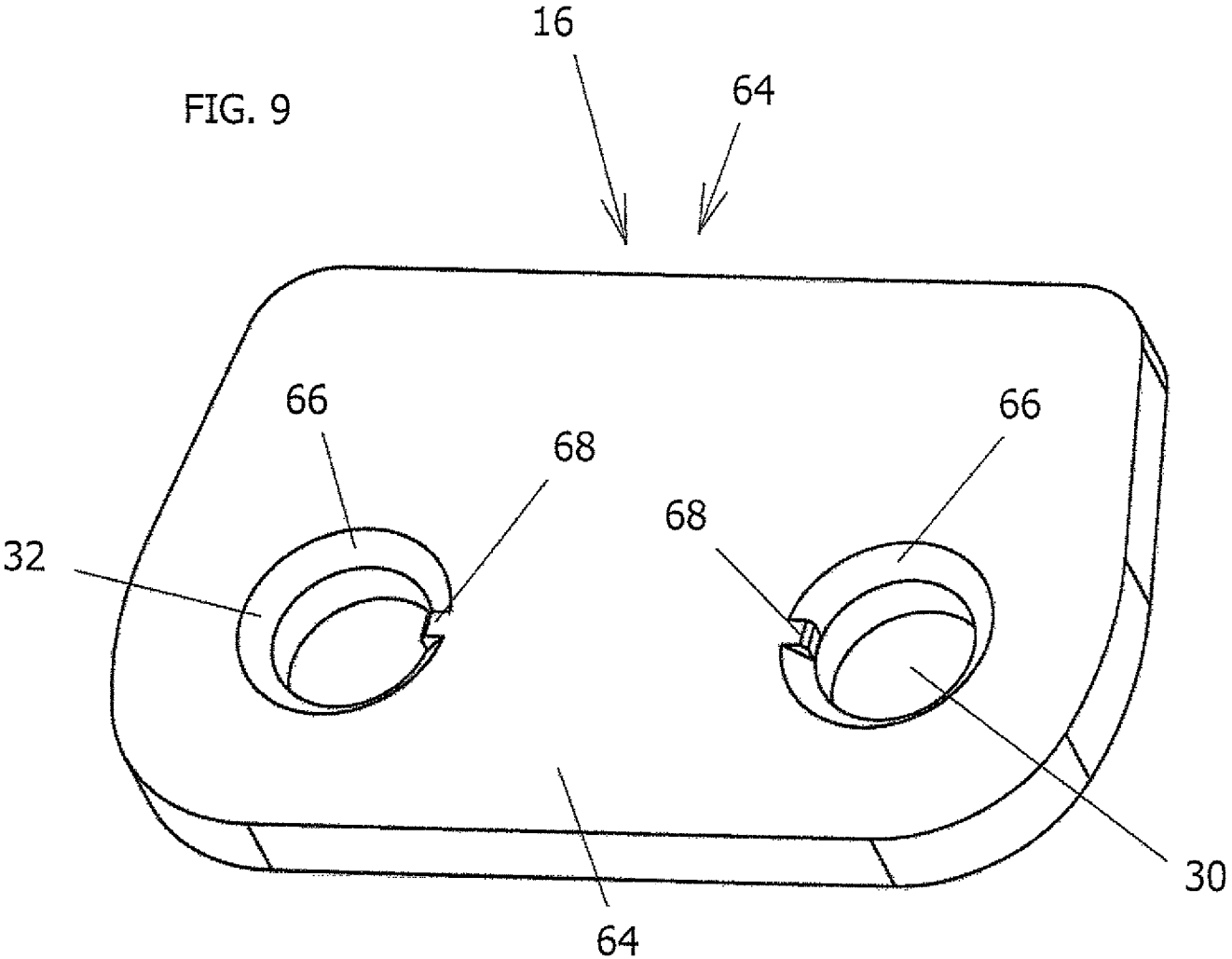
FIG. 9 is a perspective view of another embodiment of a side link according to the present disclosure.
Figure 10:
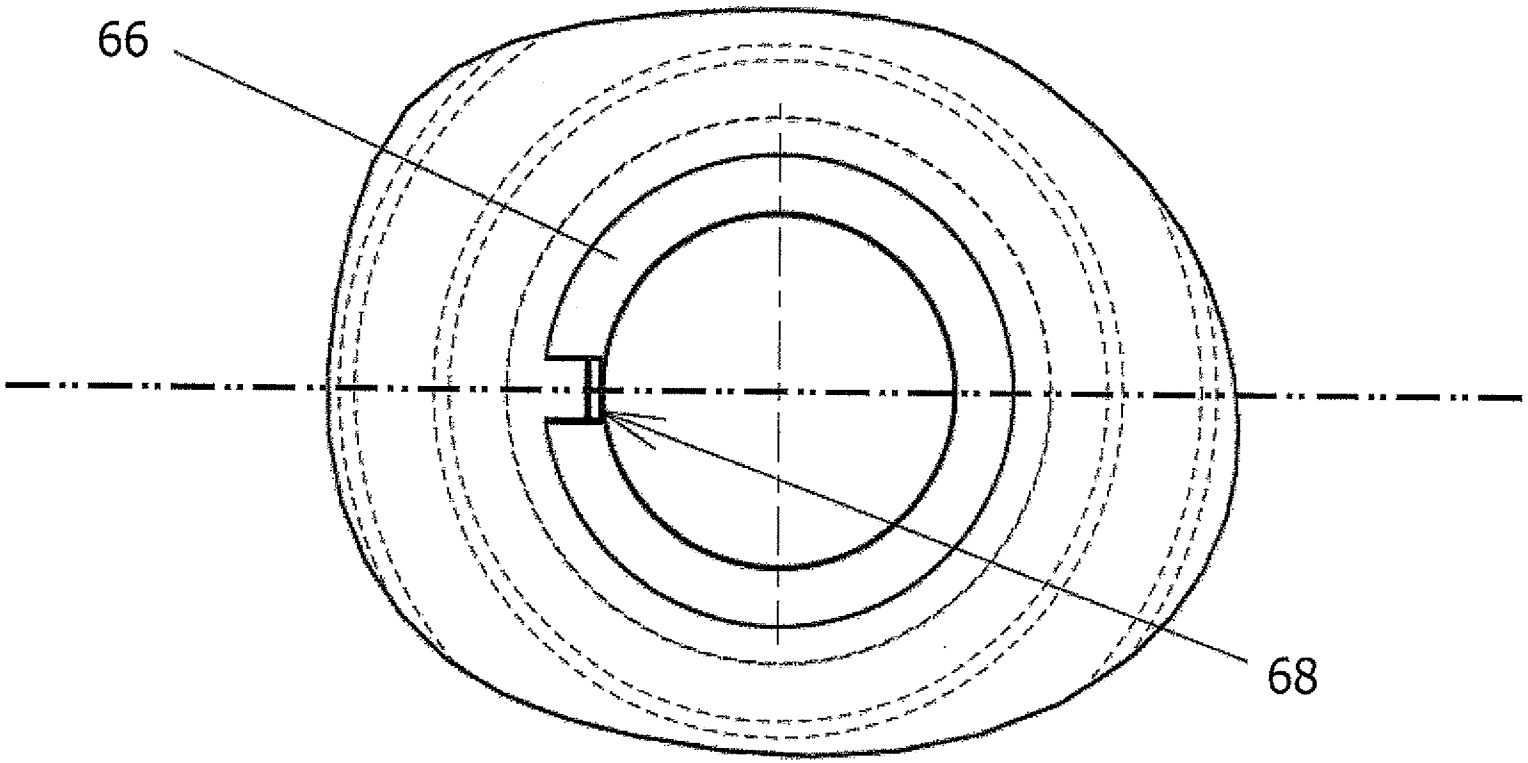
FIG. 10 is an enlarged plan view of the front or rear hole of the side link shown in FIG. 9.
Figure 11:
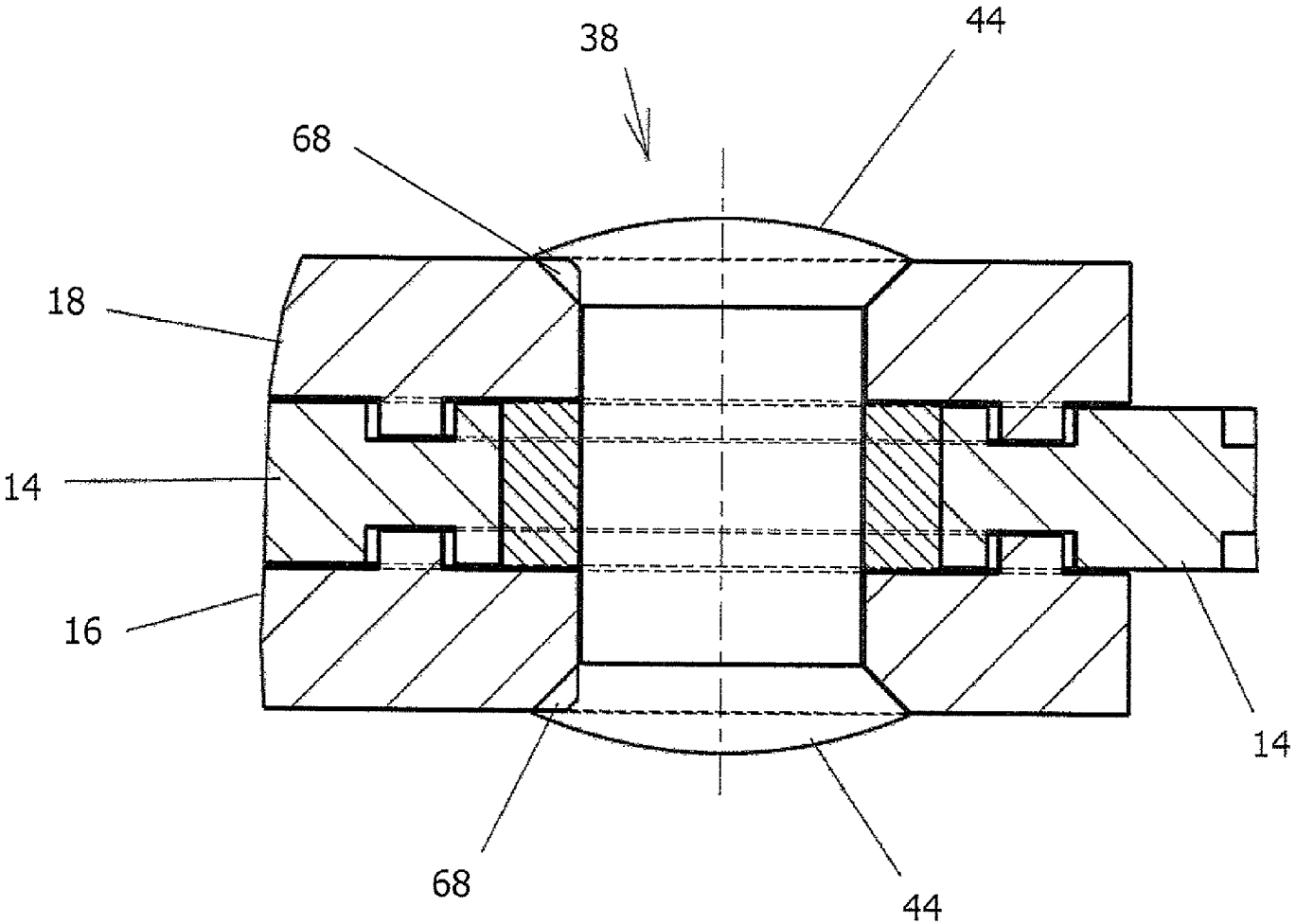
FIG. 11 is cross-sectional view of a chain link having side links shown in FIG. 9.

In another embodiment, of the present disclosure, chain 10 can have fasteners and/or side links which have rotation resisting members so that fasteners resist rotating or pivoting relative to the side link. FIGS. 9 and 10 shows one embodiment of side link 16 which can have at least one protrusion 68 extending from each beveled annular surface 66 surrounding the respective front and rear holes on the outer side 64. While not necessary, side link 18 can also include at least one protrusion 68 extending from a beveled annular surface surrounding front and rear holes of its outer side. FIG. 11 shows that as fastener 38 such as a rivet is riveted or compressed to secure side links 16, 18 to center drive link 14, rivet heads 44 flow around and engage or mate with protrusion 68 to resist rotation of side links 16, 18 relative to fastener 38.

Figure 12:
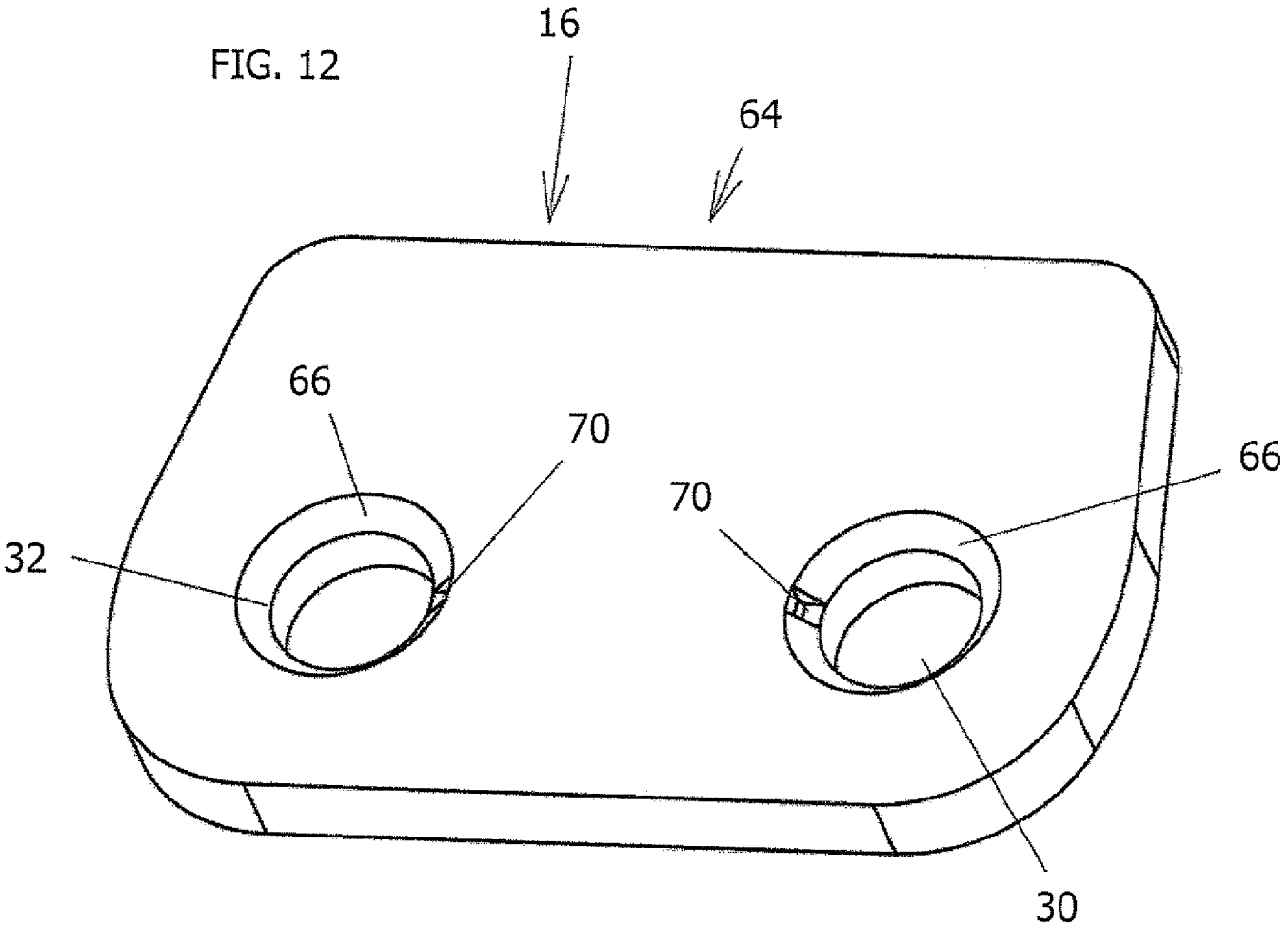
FIG. 12 is a perspective view of yet another embodiment of a side link according to the present disclosure.
Figure 13:
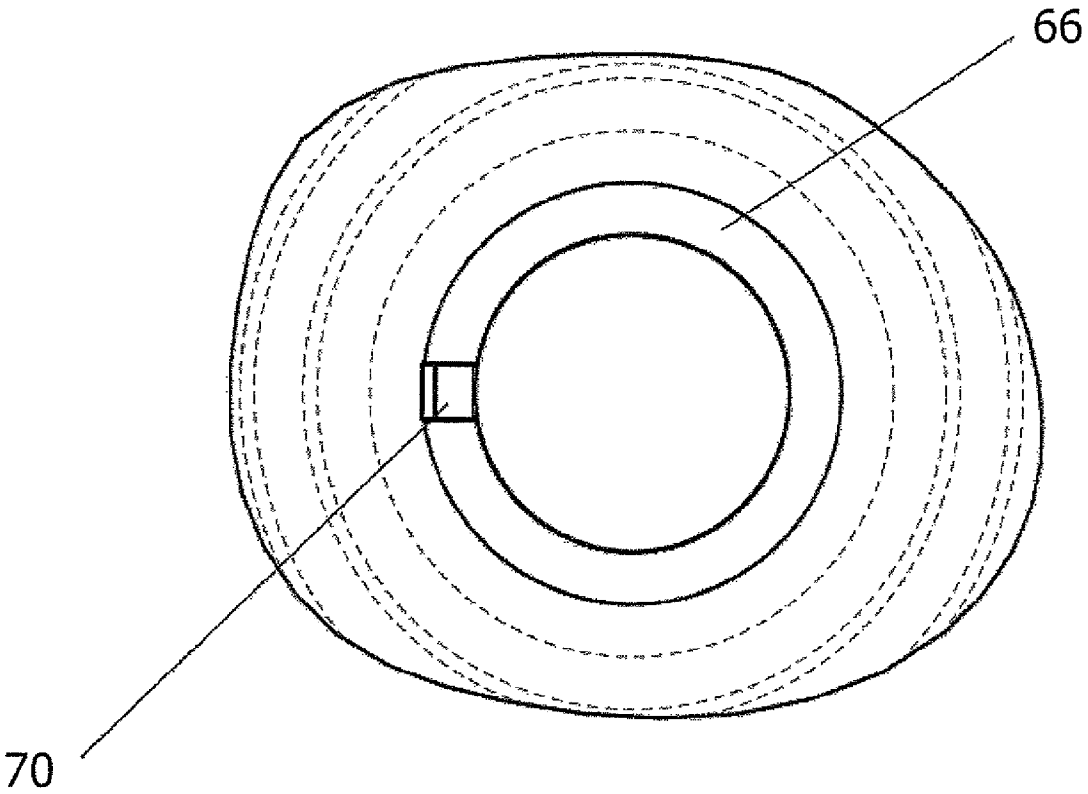
FIG. 13 is an enlarged plan view of the front or rear hole of the side link shown in FIG. 12.
Figure 14:
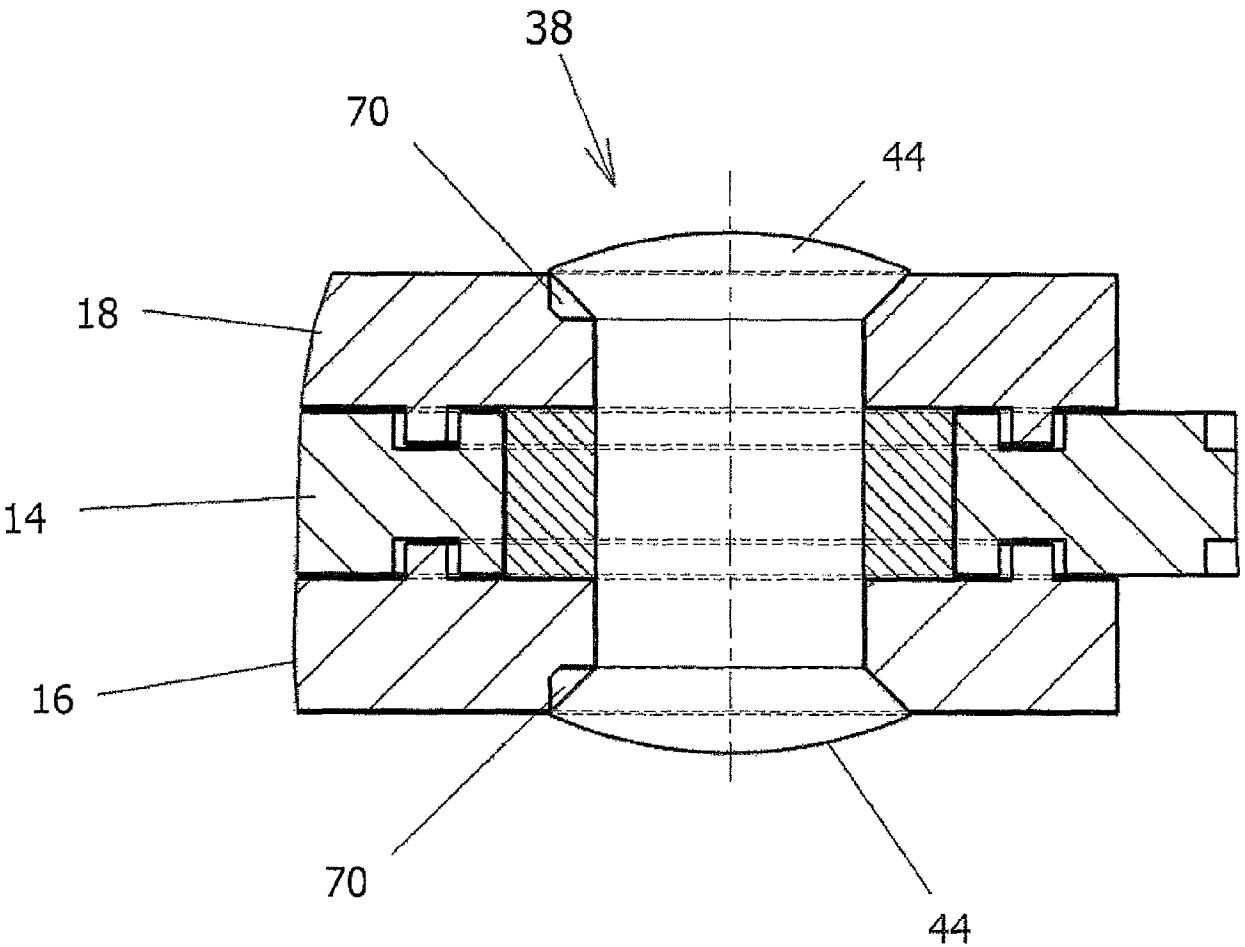
FIG. 14 is a cross-sectional view of a chain link segment having side links shown in FIG. 12.

In an alternative embodiment shown in FIGS. 12 and 13, side plate 16 and/or side link 18 can have one or more slot or depression 70 on beveled annular surface 66 surround each front and rear hole 32, 30 on the outer side 64 of side link 16. While not necessary, side link 18 can also include slot or depression 70 as discussed with reference to side link 16. As discussed above, when fastener 38 such as a rivet is riveted or compressed to secure side links 16, 18 to center drive link 14, rivet heads 44 can flow into and mate with slot or depression 70 to resist rotation relative to each other as shown in FIG. 14. Other fasteners can be used which can include one or more mating structures on a head thereof and which can be complementary to those included on the side link.

Protrusion 68 or depression 70 can be molded with side links 16, 18 or can be formed in a stamping process. The size of the protrusion or depression is dependent on the size of the side links. For a side link having the specific dimensions given above, i.e. 'SW', 'SL', 'ST', protrusion 68 and depression 70 can have a width of from about 0.3 to about 0.5 mm and have a depth of from about 0.25 mm to about 0.35 mm.

Figure 15:
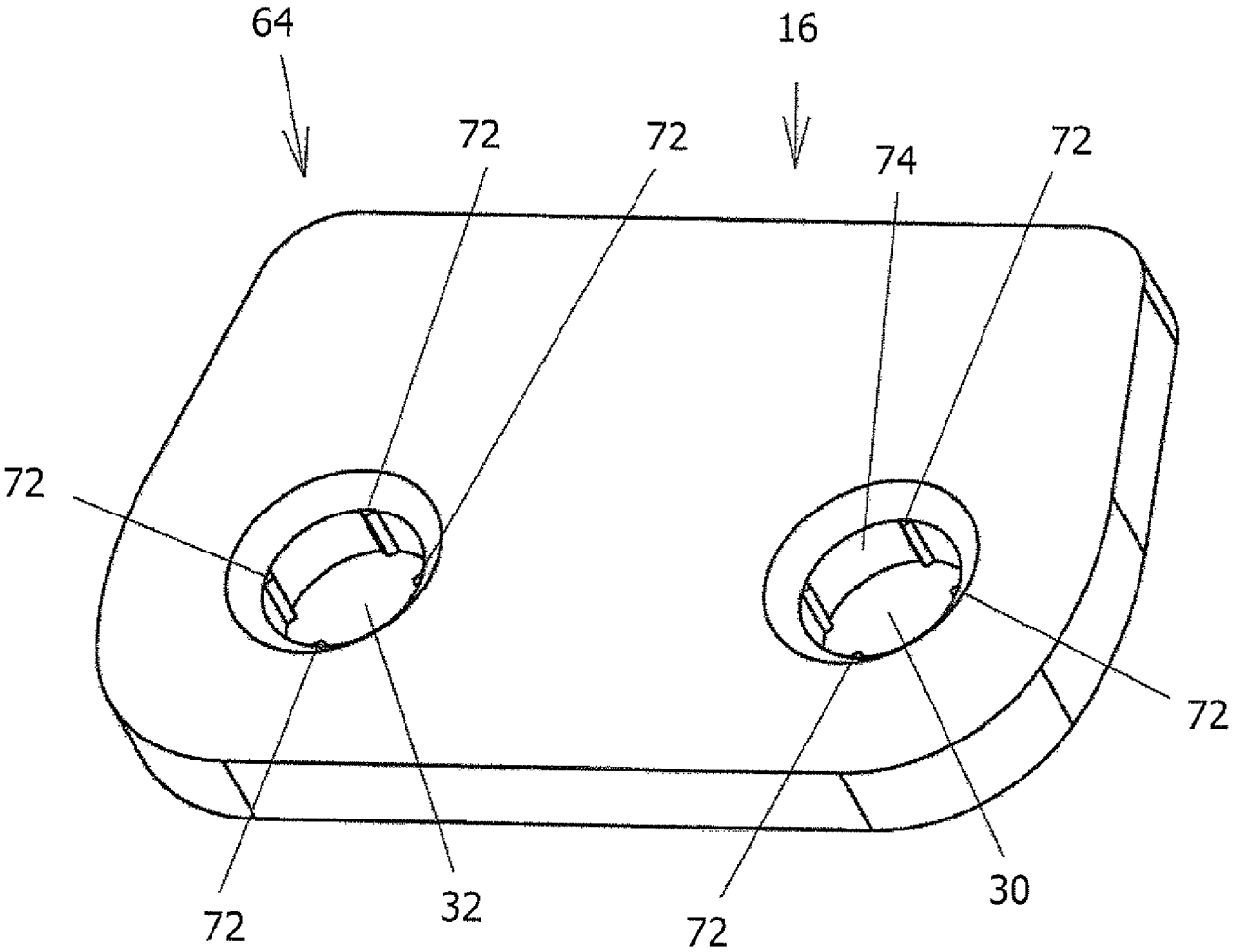
FIG. 15 is a perspective view of yet another embodiment of a side link according to the present disclosure.
Figure 16:
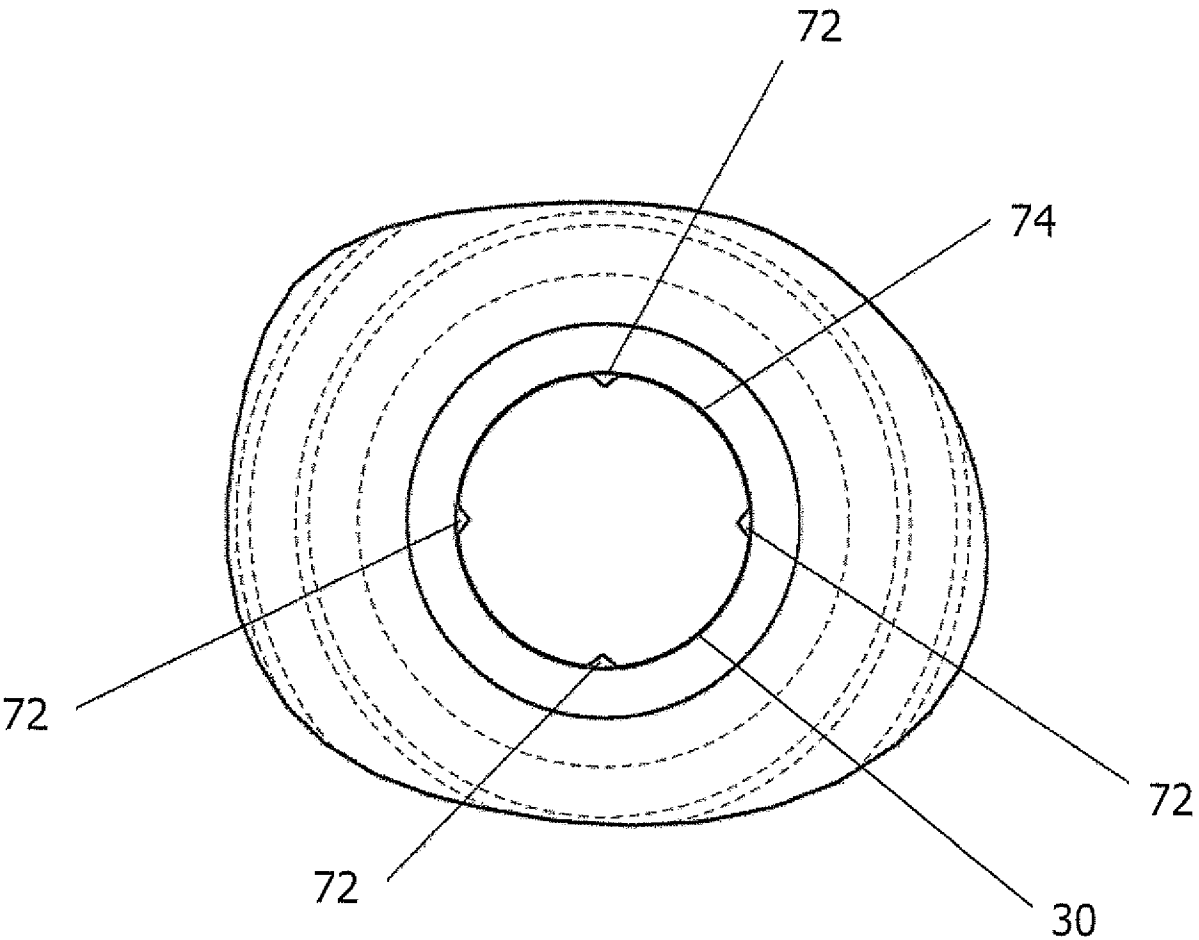
FIG. 16 is an enlarged view of the front or rear hole of the side link shown in FIG. 15.
Figure 17:
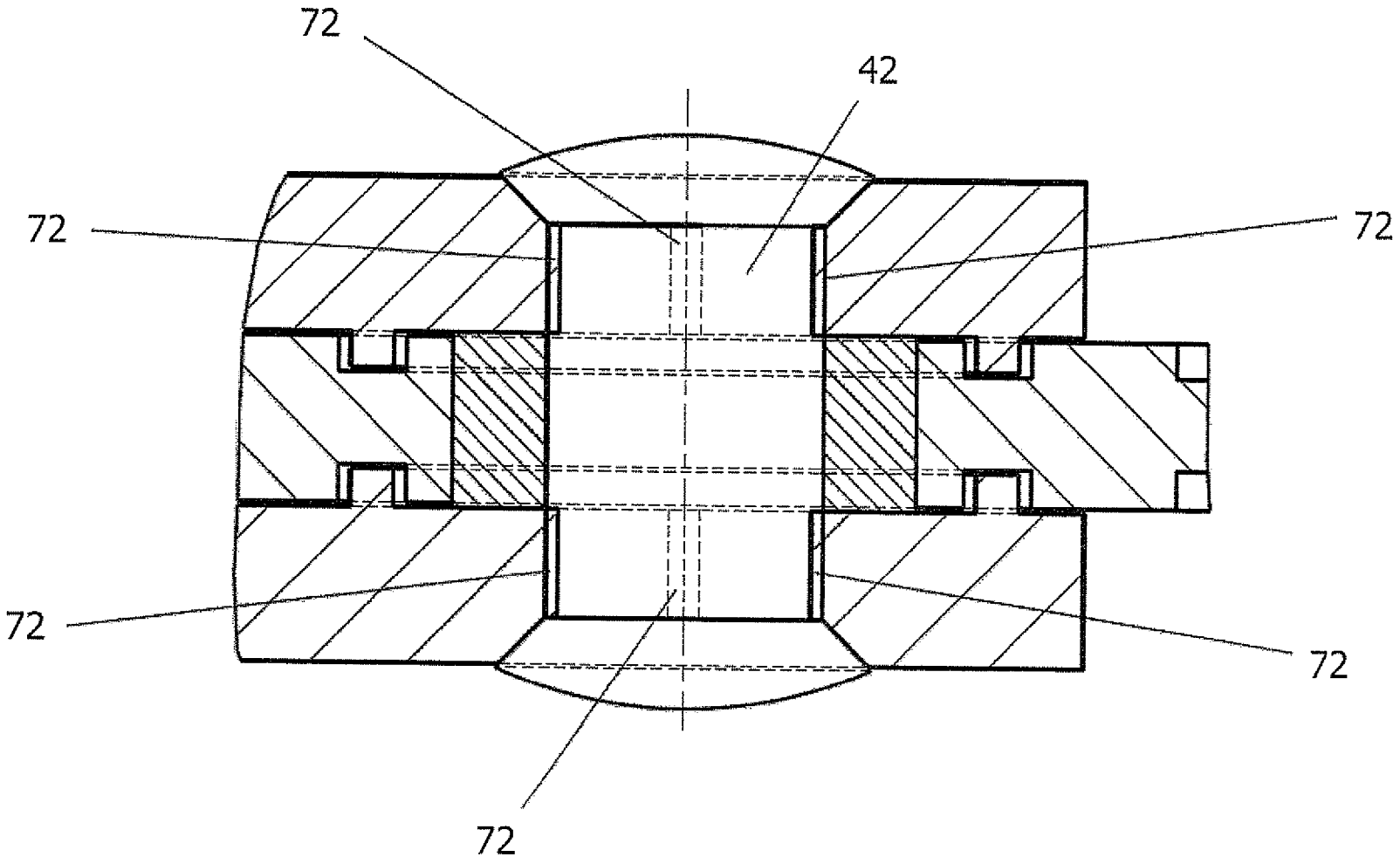
FIG. 17 is a cross-sectional view of a chain link segment having side links shown in FIG. 15.

In yet another embodiment shown in FIGS. 15 and 16, side link 16 and or side link 18 can have one or more ridges 72 extending from annular inner surface 76 defining front hole 32 and rear hole 30 can likewise have ridges 72 extending from annular inner surface 74 defining rear hole 30. While not necessary, side link 18 can likewise have ridges 72 in one or both front and rear holes 36, 34. FIG. 17 shows ridges 72 can bite into shaft 42 of fastener 38. The diameter of shaft 42 or diameter between opposing ridges 72 at the terminal end thereof can be sized to allow minimal force for inserting rivet 38 in hole 30 or require a greater force to cause ridges 72 to bite into shaft 42. Ridges 72 can extend from its respective annular surface and into its respective hole by any suitable distance for biting into the fastener and resisting rotation thereof. In one embodiment ridges 72 can extend from about 0.1 mm to about 0.15 mm.

Figure 18:
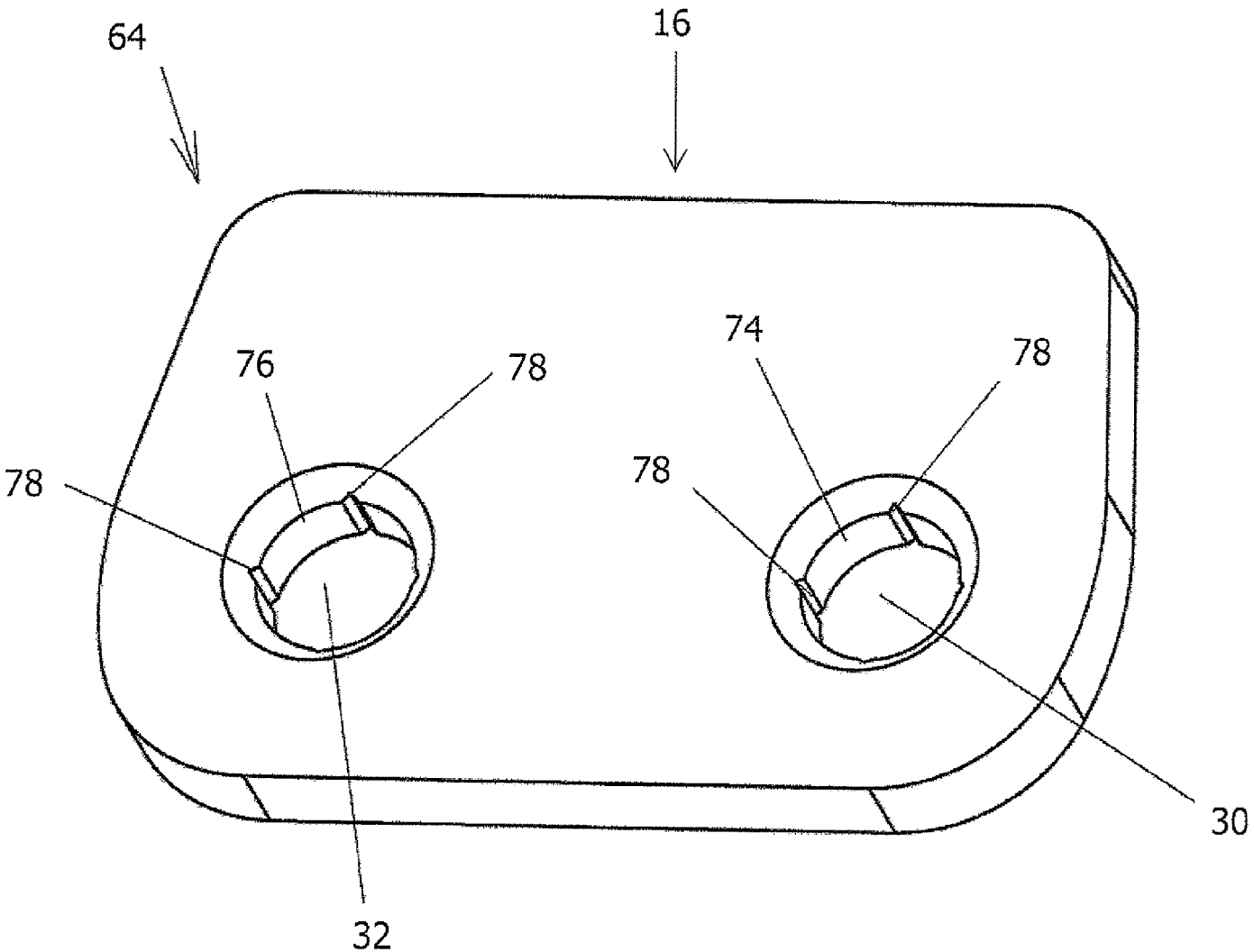
FIG. 18 a perspective view of yet another embodiment of a side link according to the present disclosure.
Figure 19:
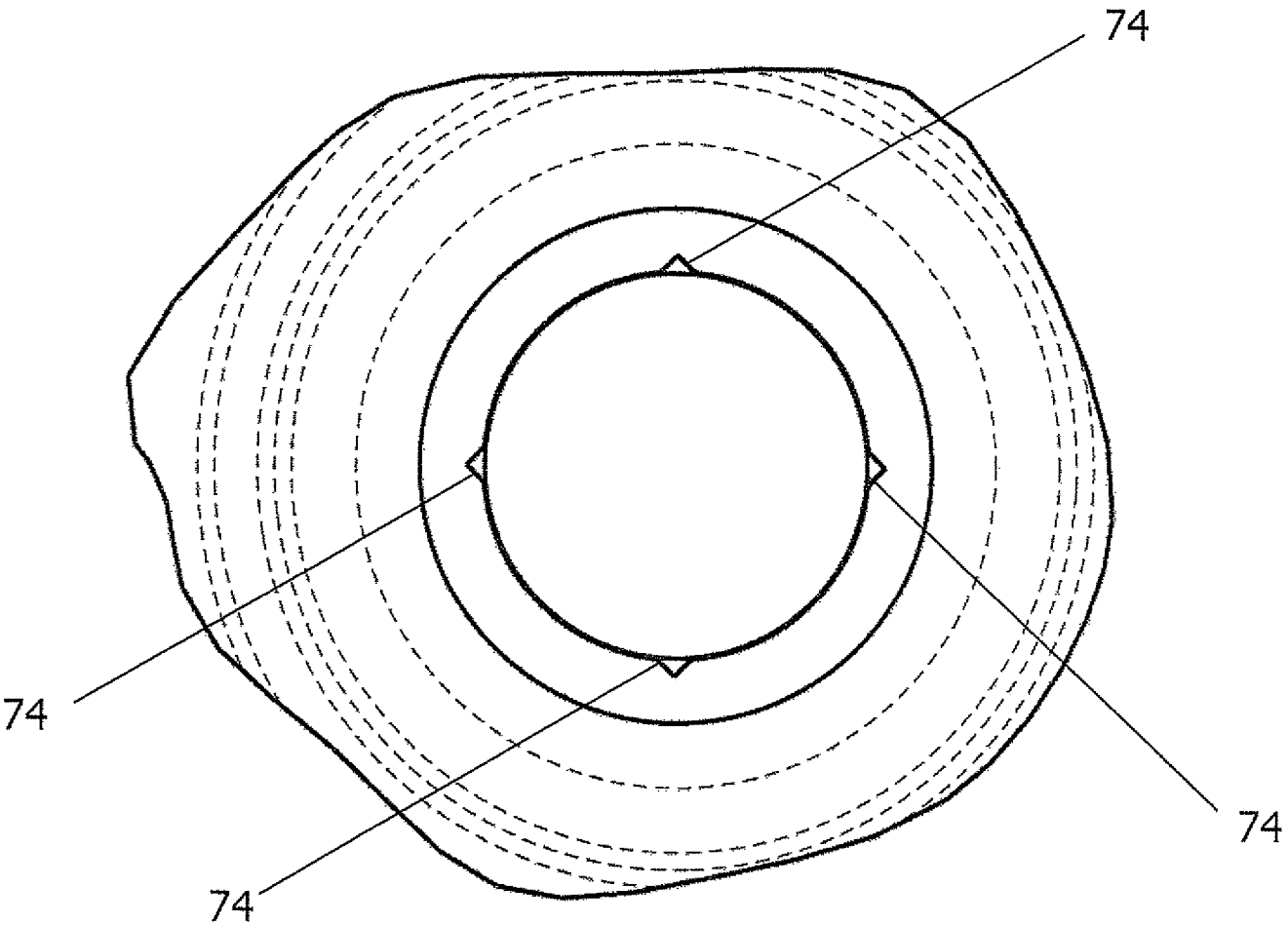
FIG. 19 is an enlarged plan view of the front or rear hole of the side link shown in FIG. 18.
Figure 20:
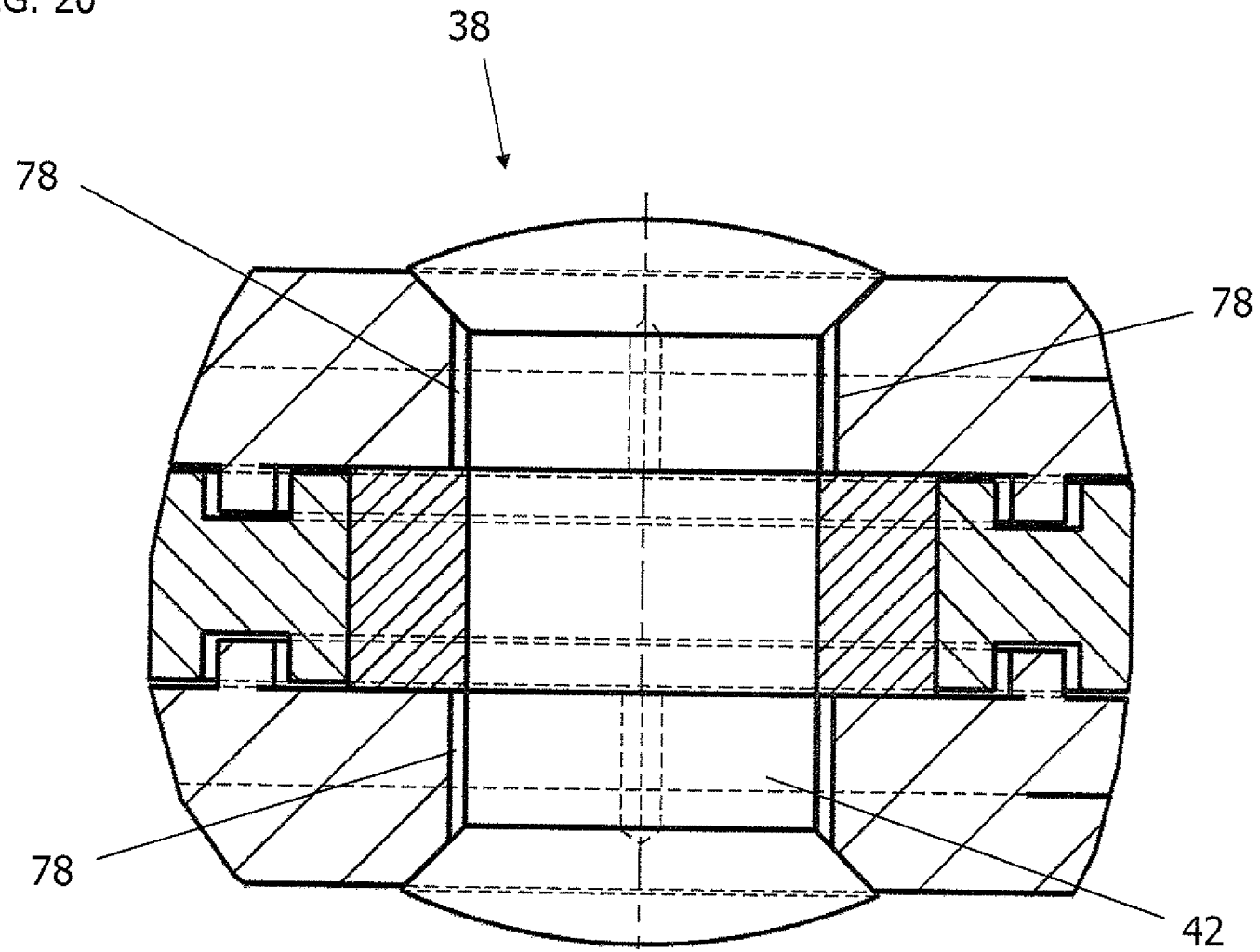
FIG. 20 is a cross-sectional view of a chain link segment having side links shown in FIG. 18.

In another alternative embodiment of rotation resisting members shown in FIGS. 18 and 19, side link 16 and or side link 18 can have one or more troughs 78 extending into annular inner surface 74 defining front hole 32 and rear hole 30 can likewise have troughs 78 extending into annular inner surface 74 defining rear hole 30. While not necessary, side link 18 can likewise have trough 78 in one or both front and rear holes 36, 34. FIG. 20 shows troughs 78 can receive material from shaft 42 of fastener 38. When fastener 38 such as a rivet is compressed or riveted, portion of shaft 42 can flow into troughs 78 resulting in fastener 38 resisting rotation relative to side links. Troughs 78 can extend into respective annular surfaces by any suitable distance to assist in resisting rotation of the fastener. In one embodiment ridges 72 can extend from about 0.1 mm to about 0.15 mm.

The previously described rotation resisting members can be used individually on one or more of side links 16, 18 or in any combination thereof. In addition, the previously described cutting chains having a debris trap protecting the bearing surfaces can include one or more of the previously described rotation resistant members in any and all combinations.

EXAMPLE 1

One embodiment of a cutting chain according to the present disclosure was compared to an existing cutting chain for wear. Wear was defined by measuring the amount each chain stretched after undergoing identical cutting operations. The greater the chain stretched the greater the sign of wear.

The existing chain included interconnected chain link segments. Each chain link segment had a center drive link position between two side links. Each chain link segment had O-rings 34 compressively forced into grooves of the side links and in contact with the center drive link to block debris and other materials from reaching the bearing surfaces by entering between the center drive link and the side links.

The cutting chain according to the present disclosure included interconnected chain link segments. Each chain link segment had a center drive link position between two side links. Each chain link segment included silicone material, particularly, cured Loctite® 5055, filing the space or debris trap formed by cooperating or interacting ribs and grooves of the side links and center drive link, respectively. The silicone was applied in liquid form to nearly fill the grooves of the center link and cured and then assembled to side links. Each chain link segment had rotation resistant member. In particular, each side link had a 0.25-0.38 mm protrusion extending from outer surfaces which engaged with each rivet head.

Both chains had a chain pitch of three eighths inch and produced a quarter inch cut. Both chains were testing on identical chain saws having a 14" guide bars and were used to cut a uniform piece of concrete. The overall length of the chain was measured before and after each test. The length was measured by opening the looped chain and measured end to end.

The chains were operated in a similar manner and cut a total of about two square meters worth of cuts each.

The cutting chain according to the present disclosure less had 28% less stretching after the concrete cutting test as compared to the existing chain, and therefore had less wear as compared to the existing chain. The improved robustness as measured by less wear results in a safer running condition for the operator and longer operating time.

The benefits of the embodiments of the disclosed subject matter have become apparent from the foregoing description. It will be understood, however, that an apparatus or device could still appropriate the subject matter claimed herein without accomplishing each and every one of those benefits gleaned from the foregoing description. The appended claims, not the benefits of the subject matter set forth herein, define the subject matter protected by law. Any and all benefits are derived from the embodiments disclosed, not necessarily the invention in general.

The invention claimed is:

1. A cutting chain comprising a plurality of pivotally interconnected chain link segments, each chain link segment including a center link having front and rear holes, a pair of side links, each side link having front and rear holes and a fastener pivotally connecting the center link between the pair of side links, the rear holes of the side links and the front hole of the center link aligned and receiving the fastener therethrough, the rear hole of the center link and the front holes of a pair of side links of an adjacent chain link segment receiving another fastener pivotally interconnecting the chain link segments to each other to form a looped cutting chain, each side link having an annular rib or an annular groove surrounding each of the front and rear holes on an inner side facing the center link and the center link having the other of the annular rib or annular groove surrounding the respective one of the front and rear holes on both sides of the center link, each of the annular ribs or annular grooves of the side links cooperating with the other of the annular ribs or annular grooves of the center link to form a debris trap, each annular rib having a rib height of from about 18% to about 26% of the thickness of the respective side link or center link from which the annular rib extends and each annular groove having a groove height of from about 18% to about 26% greater than the rib height.

2. The cutting chain of claim 1 wherein at least one of the pair of side links includes a protrusion or a depression positioned adjacent at least one of its front and rear holes, the protrusion or depression extends from a side of the side links opposite the center link and engages a head of the respective fastener wherein application of the fastener causes the head to form and flow around the protrusion or flow into the depression to prevent rotation of the side links relative to the rivet.

3. The cutting chain of claim 1 wherein each of the front and rear holes of each of the pair of side links includes at least one of a ridge or depression extending from an annular surface defining each of the respective front and rear holes for engaging an intermediate portion of the fastener wherein application of the fastener results in the fastener flowing around or into the at least one ridge or depression, respectively to prevent rotation of the fastener relative to the pair of side links.

4. The cutting chain of claim 1 wherein the annular groove and the annular rib have a rectangular cross-sectional shape.

5. The cutting chain of claim 1 wherein each of the side links includes an annular rib surrounding each of the front and rear holes of the side links on the side facing the center link and the center link includes an annular groove surrounding each of the front and rear holes of the center link on both sides of the center link for cooperating with the annular rib of the side links to form debris traps.

6. The cutting chain claim 5 wherein each annular rib has a rib width of from about 35% to about 50% of the thickness of the respective side link and each annular groove has a groove width of from about 35% to about 50% greater than the rib width of the respective annular rib.

7. The cutting chain of claim 5 wherein at least one of the pair of side links includes a protrusion positioned adjacent at least one of its front and rear holes, the protrusion extends from a side of the side links opposite the center link and engages a the respective fastener wherein application of the fastener causes a head to form and flow around the protrusion to prevent rotation of the side links relative to the rivet.

8. The cutting chain of claim 7 wherein each debris trap includes a cured silicone material therein.

9. The cutting chain of claim 1 wherein each debris trap includes a cured silicone material therein.

10. The cutting chain of claim 9 wherein each debris trap is filled with a siloxane and acrylate compound sealing the debris trap.

11. A cutting chain comprising a plurality of pivotally interconnected chain segments, each chain segment including a center link having front and rear holes, a pair of side links, and a fastener for pivotally connecting one of the pair of side links to each side of the center link, each side link having front and rear holes and opposing inner and outer sides with said inner sides facing the center link, the front holes of the side links and the rear hole of the center link align and receive the fastener therethrough, the front hole of the center link and the rear holes of a pair of side links of an adjacent chain segment align and receive another fastener to pivotally interconnect the chain segments to form a looped cutting chain, at least one of the side links including a protrusion or a depression positioned adjacent one of the front and rear holes and extending from the outer side of the side link for engagement with a head of the respective fastener to prevent rotation of fastener relative to the at least one side link.

12. The cutting chain of claim 11 wherein each center link includes opposing sides, each opposing side facing a respective side link; each of the opposing sides of the center link includes either an annular rib or an annular groove circumscribing each of the front and rear holes of the center link for cooperating with complementary annular rib or annular groove on the inner sides of the respective pair of side links circumscribing each of the respective front and rear holes thereof to form a debris trap about each of the front and rear holes of the center link.

13. The cutting chain of claim 12 wherein each side link includes two protrusions, one protrusion extending from the outer side of the side link adjacent its front hole and the other protrusion extending from the outer side of the side link adjacent its rear hole wherein application of a fastener in the form of a rivet causes a head to form and flow around the protrusion to prevent rotation of the side links relative to the rivet.

14. The cutting chain of claim 13 wherein each center link includes an annular groove on each of the opposing sides of the center link circumscribing each of the front and rear holes for cooperating with an annular rib on the inner sides of the respective pair of side links circumscribing each of the respective front and rear holes thereof to form on the opposing sides of the center link a debris trap about each of the front and rear holes.

15. The cutting chain of claim 12 wherein the center link includes an annular groove circumscribing the front hole on both of the opposing sides thereof for cooperating with complementary annular ribs on the inner sides of the rear holes of the each of the respective side links to form a debris trap about the front hole of the center link on both of the opposing sides, and an annular rib circumscribing the rear hole of the center link on both of the opposing sides thereof for cooperating with complementary annular grooves of the front holes of respective side links of an adjacent chain link segments to form a debris trap about the rear hole of the center link on both of the opposing sides.

16. The cutting chain of claim 12 wherein the center link includes an annular groove circumscribing the front and rear holes thereof on one of the opposing sides for cooperating with annular ribs circumscribing the front and rear holes on the inner side of one of the pair of the side links to form a debris trap about each of the front and rear holes on one of the opposing sides, and an annular rib circumscribing the front and rear holes of the center link on the other opposing side for cooperating with annular grooves circumscribing the front and rear holes on the inner side of the other of the respective pair of side links to form a debris trap about each of the front and rear holes on the other opposing side.

17. The cutting chain of claim 12 wherein each debris trap includes a cured silicone material therein.

18. A cutting chain comprising a plurality of pivotally interconnected chain link segments, each chain link segment including a center link having front and rear holes, two side links having front and rear holes and a fastener received in the front hole of the center link and rear holes of the two side links to connect the center link between the two side links, the front hole of the center link and the rear holes of a pair of side links of an adjacent chain segment receiving another fastener to pivotally interconnect the chain segments to form a looped cutting chain, each side link having an annular rib or an annular groove surrounding each of the front and rear holes on an inner side facing the center link and the center link having the other of the annular rib or annular groove surrounding the respective front and rear holes on both sides of the center link, the annular rib or annular groove of the side links cooperate with the other of the annular rib or annular groove of the center link to form a debris trap, at least one of the side links including a protrusion or a depression positioned adjacent one of the front and rear holes and extending from the outer side of the side link for engagement with the respective fastener wherein application of the fastener causes a head to form on the fastener and flow about the protrusion or into the depression to prevent rotation of fastener relative to the at least one side link.

19. The cutting chain of claim 18 wherein each debris trap includes a lubricant or barrier material therein.

20. The cutting chain of claim 19 wherein the lubricant or barrier material is a light curable siloxane and acrylate compound.

* * * * *